US008707830B2

(12) United States Patent
Huang

(10) Patent No.: US 8,707,830 B2
(45) Date of Patent: Apr. 29, 2014

(54) SOCKET

(75) Inventor: Ping-Wen Huang, Taichung (TW)

(73) Assignee: New Way Tools Co., Ltd., Taichung (TW)

( * ) Notice: Subject to any disclaimer, the term of this patent is extended or adjusted under 35 U.S.C. 154(b) by 163 days.

(21) Appl. No.: 12/911,837

(22) Filed: Oct. 26, 2010

(65) Prior Publication Data

US 2012/0096992 A1 Apr. 26, 2012

(51) Int. Cl.

| | |
|---|---|
| ***B25B 13/50*** | (2006.01) |
| ***B25B 13/06*** | (2006.01) |
| ***B25B 13/02*** | (2006.01) |
| ***B25B 23/10*** | (2006.01) |
| ***B25B 27/18*** | (2006.01) |
| ***B25B 27/14*** | (2006.01) |

(52) U.S. Cl.
CPC ..... *B25B 23/103* (2013.01); *B25B 27/18* (2013.01); *B25B 27/143* (2013.01)
USPC ..... 81/53.2; 81/121.1; 81/125

(58) Field of Classification Search
CPC ..... B25B 13/02; B25B 13/06
USPC ..... 81/53.2, 124.6, 441, 125, 121.1
See application file for complete search history.

(56) References Cited

U.S. PATENT DOCUMENTS

| | | | | |
|---|---|---|---|---|
| 6,598,498 | B1 | 7/2003 | Pigford et al. | 81/53.2 |
| 7,152,508 | B2 | 12/2006 | McCalley, Jr. et al. | 81/53.2 |
| 7,484,440 | B2 * | 2/2009 | Wright | 81/121.1 |
| 2004/0016324 | A1 * | 1/2004 | Wright | 81/121.1 |
| 2005/0150331 | A1 | 7/2005 | Horobec | 81/53.2 |
| 2006/0117917 | A1 | 6/2006 | Lin | 81/125 |
| 2008/0245195 | A1 | 10/2008 | Lee | 81/124.6 |

FOREIGN PATENT DOCUMENTS

| | | |
|---|---|---|
| CN | 2254025 Y | 5/1997 |

OTHER PUBLICATIONS

German Utility Model No. DE 20308049 U1, Oct. 16, 2003, 13 pages.
German Utility Model No. DE 20308050 U1, Sep. 4, 2003, 14 pages.
German Invention Patent Publication No. DE 102007040144 A1, Apr. 23, 2009, 5 pages.

* cited by examiner

*Primary Examiner* — Monica Carter
*Assistant Examiner* — Danny Hong
(74) *Attorney, Agent, or Firm* — Alan Kamrath; Kamrath IP Lawfirm, P.A.

(57) ABSTRACT

A socket for driving a fastener, having a damaged head, includes a hole defining an inner peripheral edge. The inner peripheral edge defines a plurality of engaging sides and slots. Each engaging side includes first, second, and third sections. The first section extends from one slot and approaches to a center of the hole, the second section extends from the first section and away from the center of the hole, and the third section extends from the second section and towards and connects to another slot.

11 Claims, 8 Drawing Sheets

SOCKET

BACKGROUND OF THE INVENTION

1. Field of the Invention

The present invention relates to a socket and, particularly, to a socket best used for loosening a rusted and rotten fastener or a fastener which corners have been damaged.

2. Description of the Related Art

It is known that a fastener has a polygonal head for engagement with a driving member, with the driving member being used to drive the head of the fastener for tighten/loosening the fastener. Unfortunately, it has always been a problem to loosen a fastener which has been tightened unduly or which has become rusted and rotten. One reason is because a force that is applied to the fastener has to be very large in order to loosen it. Another reason is that the driving member would damage and wear the acute corners during the operation thereof. It is noted that each acute corner defined between two adjacent sides of the polygonal head would suffer a "collapse" problem, namely, the corner becomes arcuate and is no longer acute. Consequently, it becomes impossible to loosen the fastener from the object no matter how hard the driving member is turned.

China Pat. No. ZL 96215962.X teaches a spanner for wrenching a worn nut. The structure thereof, however, is complicated, which inflicts high cost of manufacture.

The present invention is, therefore, intended to obviate or at least alleviate the problems encountered in the prior art.

SUMMARY OF THE INVENTION

According to the present invention, a socket drives a fastener, having a head a wrenching tool is adapted to engage but having corners which are or have become damaged. The socket includes a hole extending therethrough and defines an outer peripheral edge and an inner peripheral edge. The inner peripheral edge defines a plurality of engaging sides and slots extending longitudinally. Two adjacent engaging sides are disposed on two opposite boundaries of one slot, and each engaging side is angled with an adjacent engaging side. Furthermore, each engaging side includes first, second, and third sections extending longitudinally. The first section includes a first terminal side coincident with one of the two boundaries of one slot and a second terminal side and approaches to a center of the hole as it extends from the first terminal side to the second terminal side. The second section includes a first terminal side coincident with the second terminal side of the first section and a second terminal side and extends away from the center of the hole as it extends from the first terminal side to the second terminal side. The third section includes a first terminal side coincident with the second terminal side of the second section and a second terminal side coincident with one of the two boundaries of one slot. Each slot is radially and equally spaced from the center of the hole.

In addition, when the socket is engaged with the wrenching tool to drive the fastener, the head of the fastener is received within the hole of the socket and is only in contact with the second terminal side of the first section of each engaging side defining an engaging point prior to operably moving the socket, the outer peripheral edge of the socket is abutted against a driving end of the wrenching tool, and the head of the fastener is aligned coaxially with the socket and the driving end of the wrenching tool and defines a coaxial line.

It is an object of the present invention to provide a socket best used for loosening a rusted and rotten fastener or a fastener with corners which have been damaged.

It is another object of the present invention to provide a socket that has a lower manufacturing cost than a conventional socket.

It is a further object of the present invention to provide a socket having a sufficient structural strength against a possible deformation problem when undergoing a large toque force during the operation of loosening the fastener.

Other objects, advantages, and new features of the present invention will become apparent from the following detailed description of the invention when considered in conjunction with the accompanied drawings.

DETAILED DESCRIPTION OF THE PREFERRED EMBODIMENTS

Figure 1:
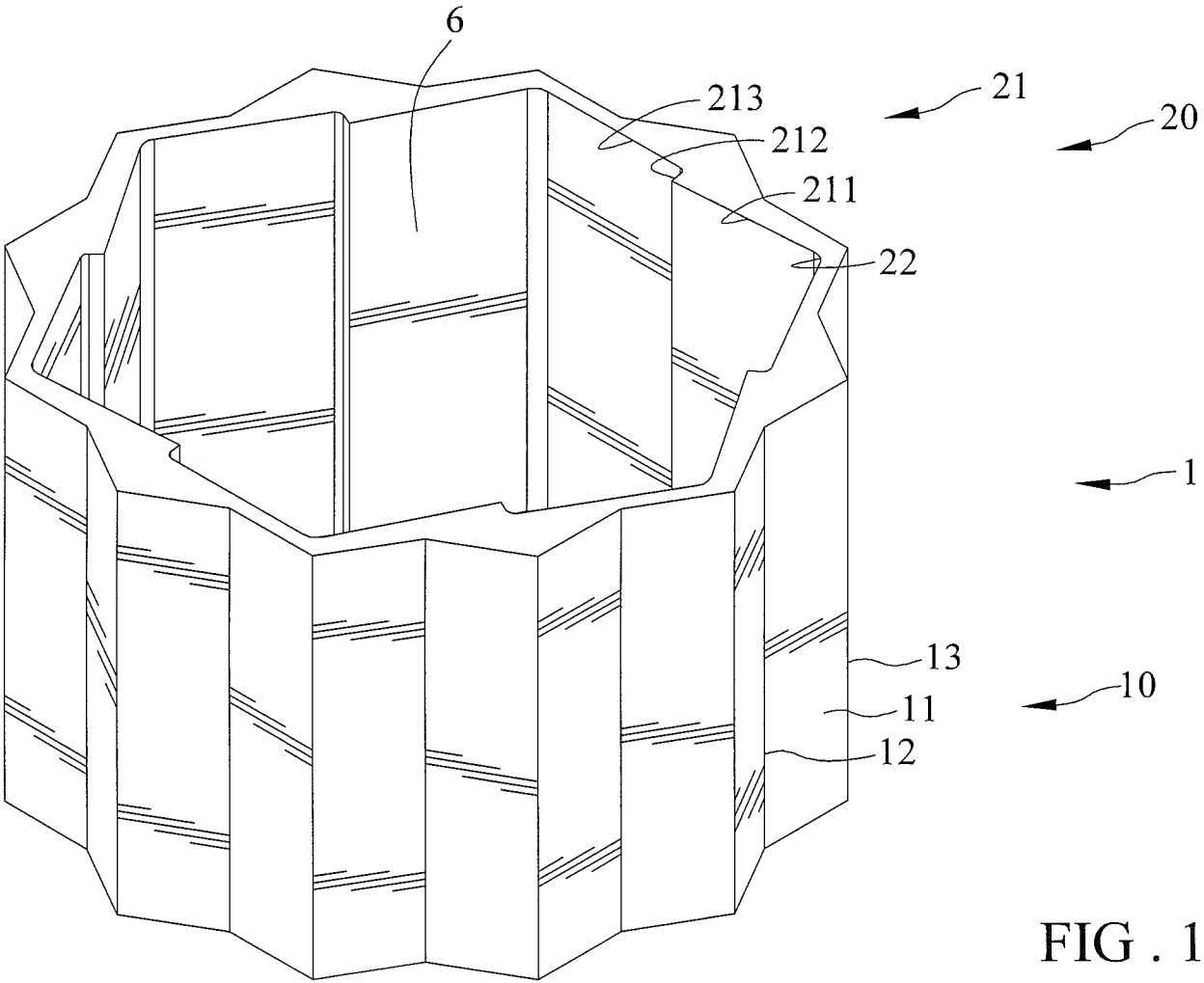
FIG. 1 is a perspective view of a socket in accordance with the present invention.
Figure 2:
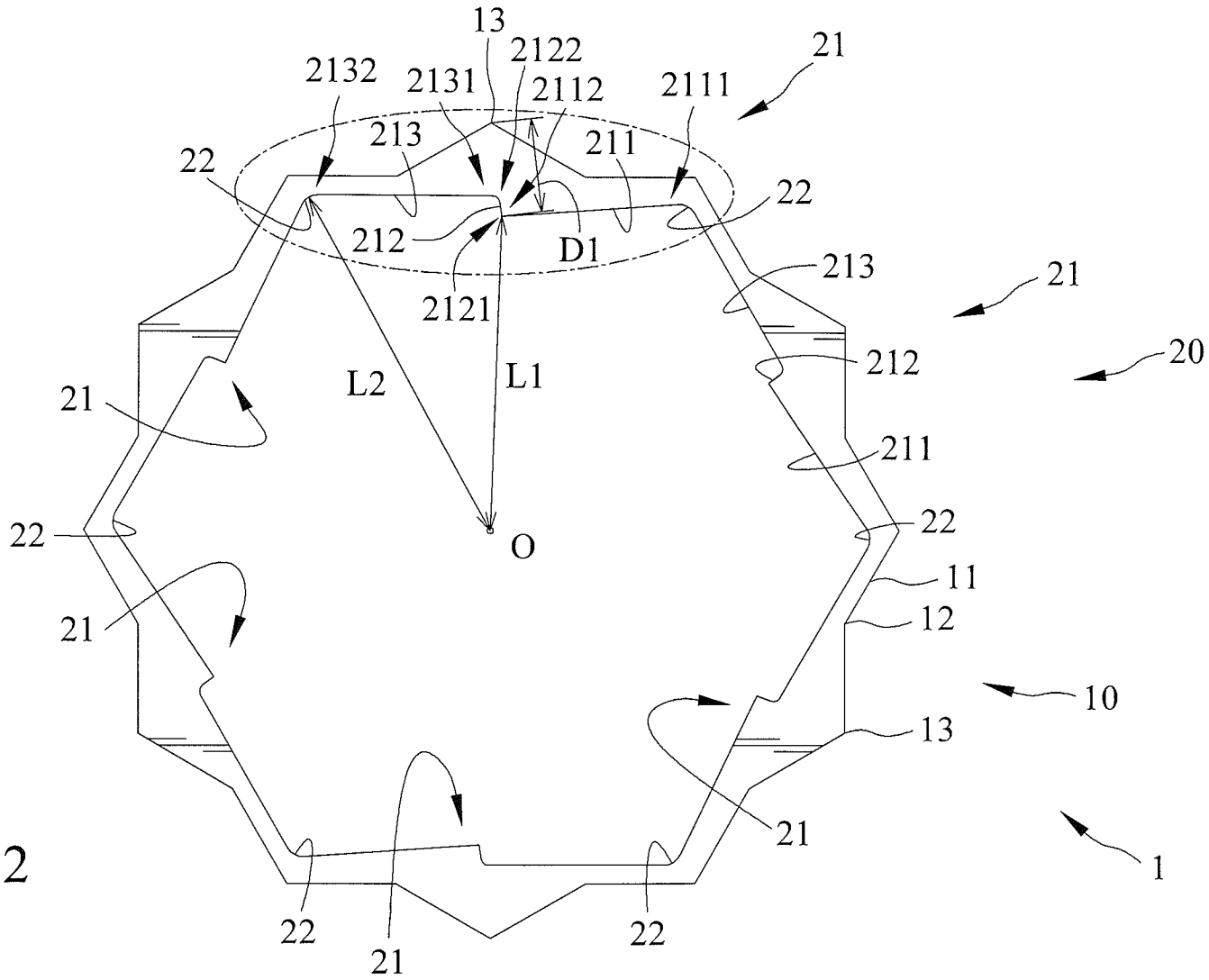
FIG. 2 is a cross-sectional view of the socket shown in FIG. 1.
Figure 3:
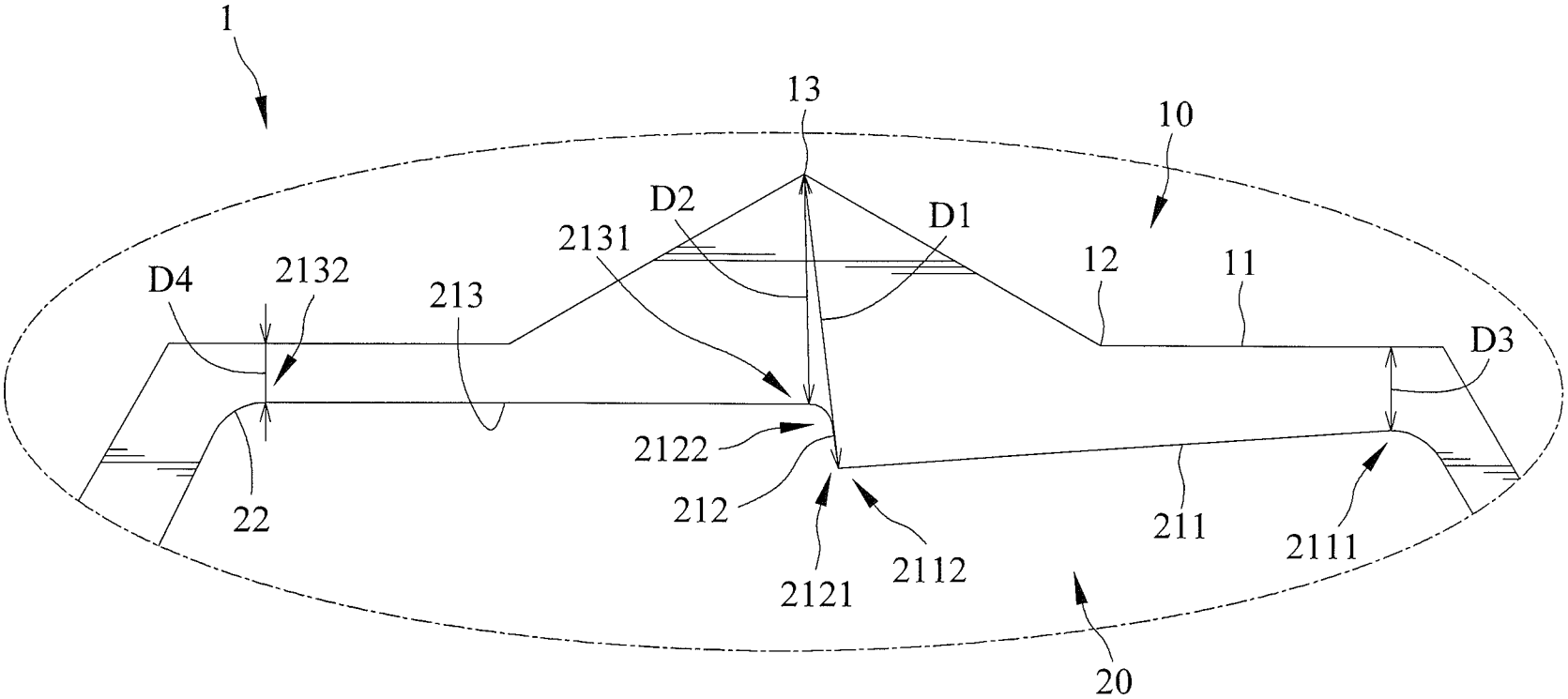
FIG. 3 is a partial, enlarged view of FIG. 2.
Figure 4:
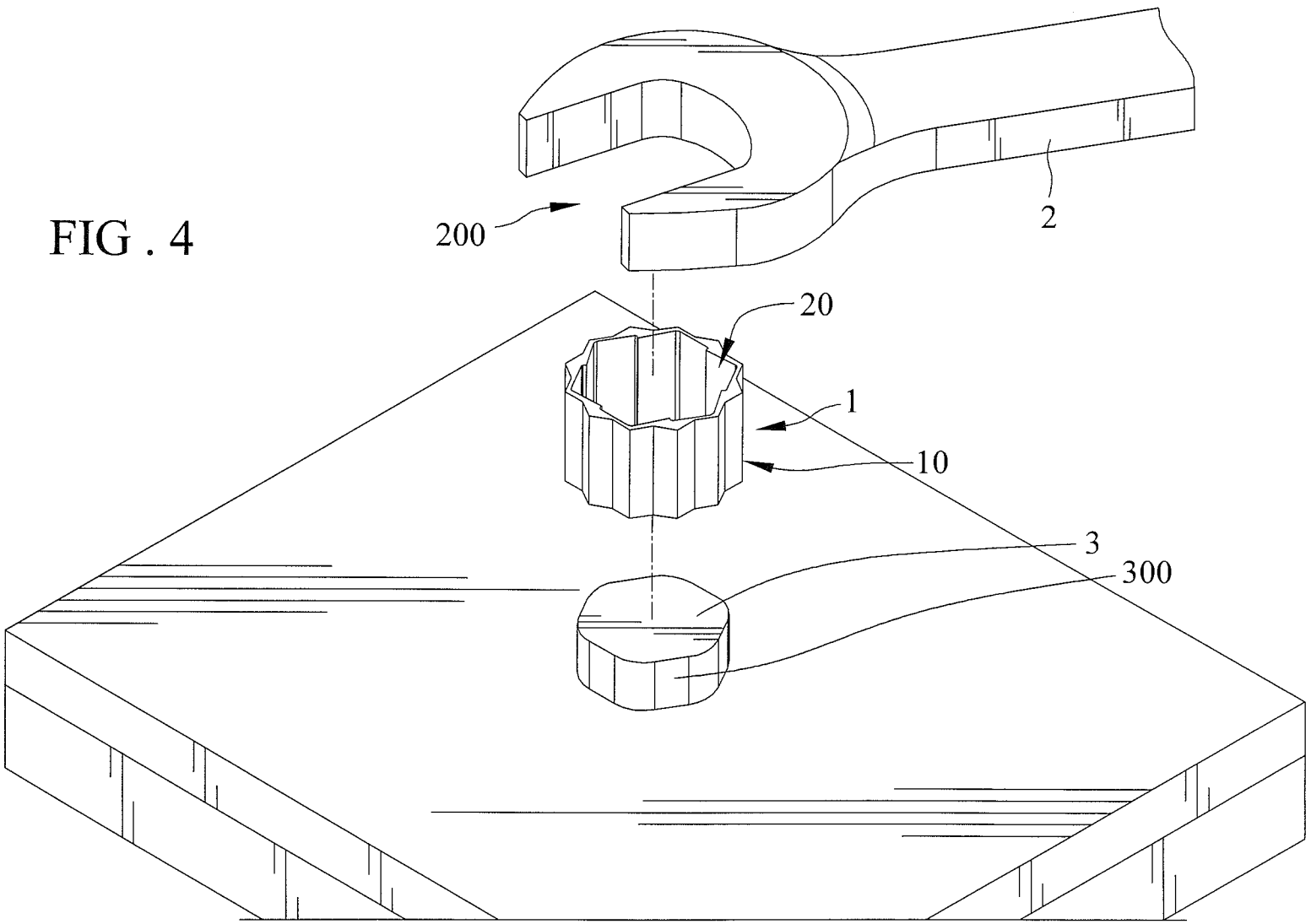
FIG. 4 illustrates the socket shown in FIG. 1 cooperated with a wrenching tool for loosening a fastener.
Figure 5:
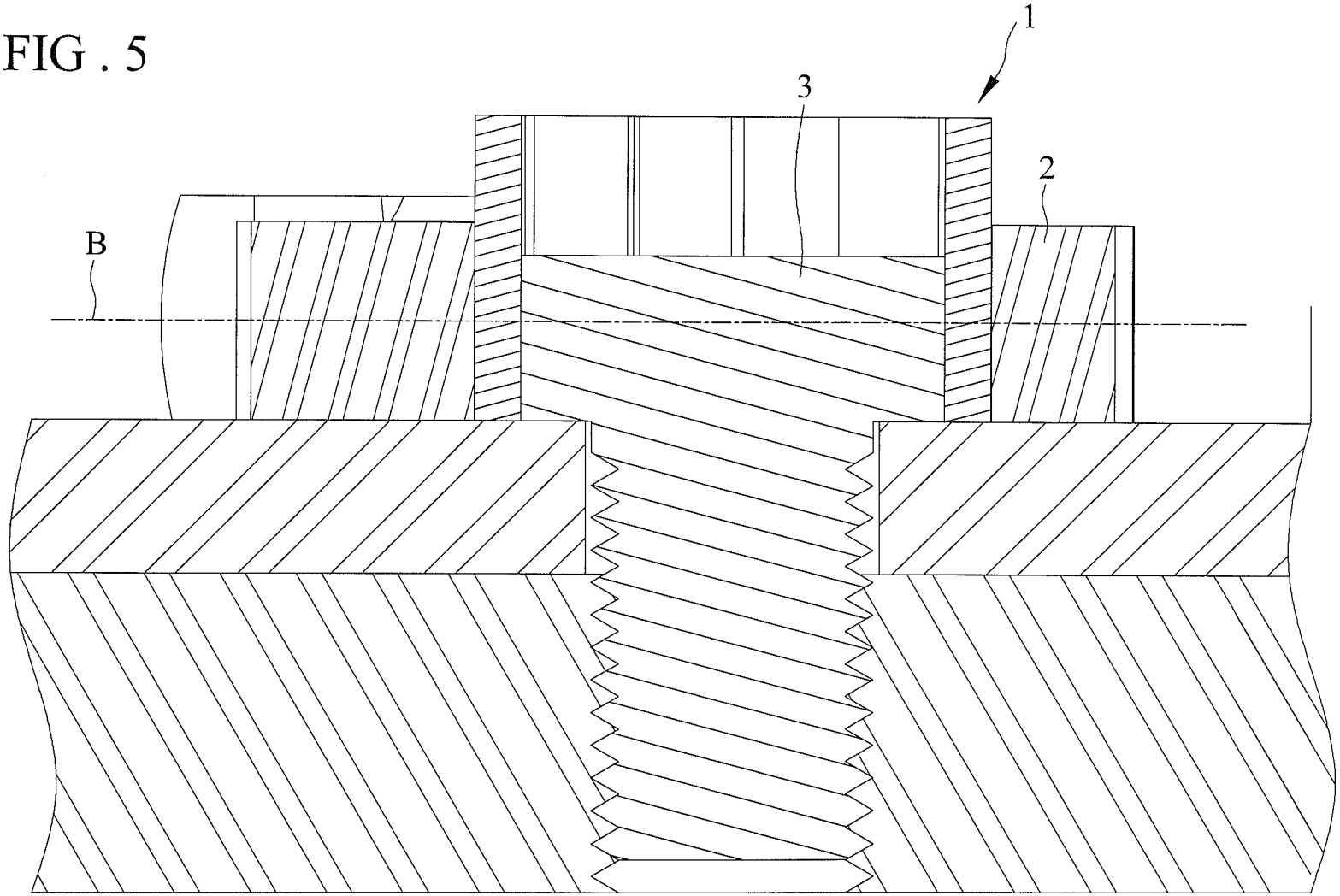
FIG. 5 is a cross-sectional view illustrating the fastener, the socket, and the wrenching tool shown in FIG. 4, with the fastener received in the socket, and with the socket engaged with the wrenching tool.
Figure 6:
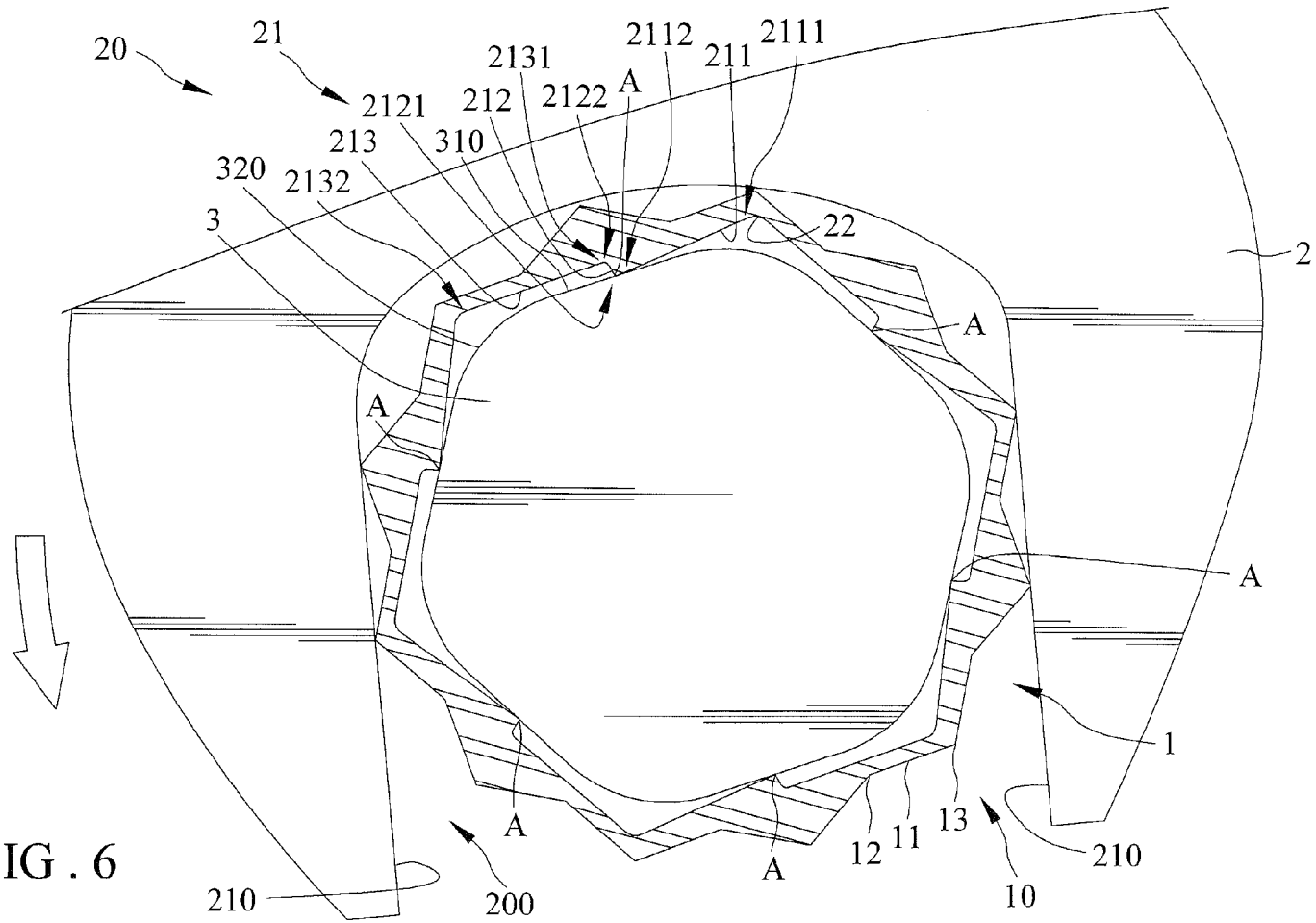
FIG. 6 is an extended cross-sectional view of FIG. 5 and illustrates the operational direction of the socket.

Referring to the drawings, a socket 1 best used for loosening a fastener 3 that suffers a problem as set forth in the description of the related art, is hollow as it includes a hole 6 extending therethrough. The hole 6 has a depth the same as a depth of the socket 1 and defines an outer peripheral edge 10 and an inner peripheral edge 20. The outer peripheral edge 10 is polygonal and includes a plurality of sides 11. In this preferred embodiment, the outer peripheral edge 10 includes twenty-four sides 11. Furthermore, each side 11 is defined between two other sides 11 and defines a first cooperated edge 12 with one of the two other sides 11 and a second cooperated edge 13 with the other of the two other sides 11. In the preferred embodiment, there are twelve first cooperated edges 12 and twelve second cooperated edges 13. The first and second cooperated edges 12 and 13 are parallel to each other. Each first cooperated edge 12 extends longitudinally, such that it has a length the same as the depth of the socket 1. Likewise, each second cooperated edge 13 extends longitudinally, such that it has a length the same as the depth of the socket 1. Moreover, the first and second cooperated edges 12 and 13 are radially spaced from a center "O" of the hole 6 of the socket 1, and each first cooperated edge 12 is closer to the center "O" than each second cooperated edge 13. Additionally, the inner peripheral edge 20 delimits the boundary of the hole 6 and defines a plurality of engaging sides 21 and a plurality of slots 22. Each engaging side 21 extends longitudinally, such that it has a length the same as the depth of the socket 1. Likewise, each slot 22 extends longitudinally, such that it has a length the same as the depth of the socket 1. Furthermore, two adjacent engaging sides 21 are disposed on two opposite boundaries of one slot 22. Each engaging side 21 is angled with an adjacent engaging side 21 and includes a first section 211, a second section 212, and a third section 213. The first section 211 of each engaging side 21 extends longitudinally such that it has a depth the same as that of the related engaging side 21. The first section 2111 includes a first terminal side 2111 coincident with one of the two boundaries of one slot 22 and a second terminal side 2112, and approaches to the center "O" as it extends from the first terminal side 2111 to the second terminal side 2112. As shown in FIG. 2, the second terminal side 2112 of the first section 211 of each engaging side 21 is radially spaced from the center "O" by a radial distance "L1". The second section 212 of each engaging side 21 extends longitudinally such that it has a depth the same as that of the related engaging side 21. The second section 212 includes a first terminal side 2121 coincident with the second terminal side 2112 of the first section 211 in that engaging side 21 and a second terminal side 2122. The second section 212 is further away from the center "O" and towards one second cooperated edge 13 as it extends from the first terminal side 2121 to the second terminal side 2122. The third section 213 of each engaging side 21 extends longitudinally such that it has a depth the same as that of the related engaging side 21, The third section 213 includes a first terminal side 2131 coincident with the second terminal side 2121 of the second section 212 in that engaging side 21 and a second terminal side 2132 coincident with one of the two boundaries of one slot 22. Also, with respect to each engaging side 21, the first terminal side 2121 of the second section 212 (or the second terminal side 2112 of the first section 211) is spaced from the second cooperated edge 13 that the second section 212 extends towards by a distance "D1"; the first terminal side 2131 of the third section 213 is spaced from that second cooperated edge 13 by a shorter distance, "D2"; the first terminal side 2111 of the first section 211 is spaced from the outer peripheral edge 10 by a perpendicular distance "D3"; and the second terminal side 2132 of the third section 213 is spaced from the outer peripheral edge 10 by a perpendicular distance "D4". The perpendicular distance "D4" is smaller than the perpendicular distance "D3". Additionally, each slot 22 defined in the inner peripheral edge 20 is opposing and adjacent to one second cooperated edge 13 defined on the outer peripheral edge 10. Each slot 22 defines a bottom that is the furthest away from the center "O", i.e., no other structural section of the inner peripheral edge 20 has a greater radial distance with respect to the center "O". As shown in FIG. 2, each slot 22 is radially spaced from the center "O" by a radial distance "L2". The radial distance "L2" is greater than the radial distance "L1".

FIGS. 4 through 7 show a wrenching tool, a wrench 2, engaged with the socket 1 to loosen the fastener 3. The wrench 2 includes a driving end 200 defined at a distal end thereof. The driving end 200 includes a cavity (not numbered) extending therethrough. The driving end 200 defines two opposite engaging surfaces 210. The cavity is not enclosed. The fastener 3 includes a head 300 for engagement with the socket 1. The head 300 includes a circumferential edge defining a plurality of peripheral sides 310 and a plurality of corners 320, and each corner 320 is defined between two adjacent peripheral sides 310. Furthermore, each corner 320 is or has become arcuate. As set forth in the description of the related art, it is impossible to loosen the fastener 3 with the wrench 2 because the wrench 2 just turns relatively to the fastener 3. Notwithstanding, the fastener 3 is able to be loosened by cooperation with the socket 1. When the socket 1 is used, two second cooperated edges 13 on the outer peripheral edge 10 of the socket 1 are abutted against one engaging surface 210 while two second cooperated edges 13 on the outer peripheral edge 10 of the socket are abutted against the other engaging surface 210, and the fastener 3 is received within the hole 6 of the socket 1 so the head 300 of the fastener 3 is aligned coaxially with the socket 1 and the driving end 200 of the wrench 2, and defines a coaxial line "B". In addition, the fastener 3 is only in contact with the second terminal side 2112 of the first section 211 of each engaging side 21 prior to operably moving the socket 1, i.e., each engaging side 21 defines an engaging point "A" in contact with the circumferential edge of the head 300 of the fastener 3, and each peripheral side 310 of the circumferential edge of the head 300 and the first section 211 of each engaging side 21 cooperate to define an acute angle. Furthermore, in order to loosen the fastener 3, the socket 1 has to be turned in a direction not decreasing the acute angle defined between each peripheral side 310 of the circumferential edge of the head 300 and the first section 211 of each engaging side 21 (as indicated by the arrow).

Figure 7:
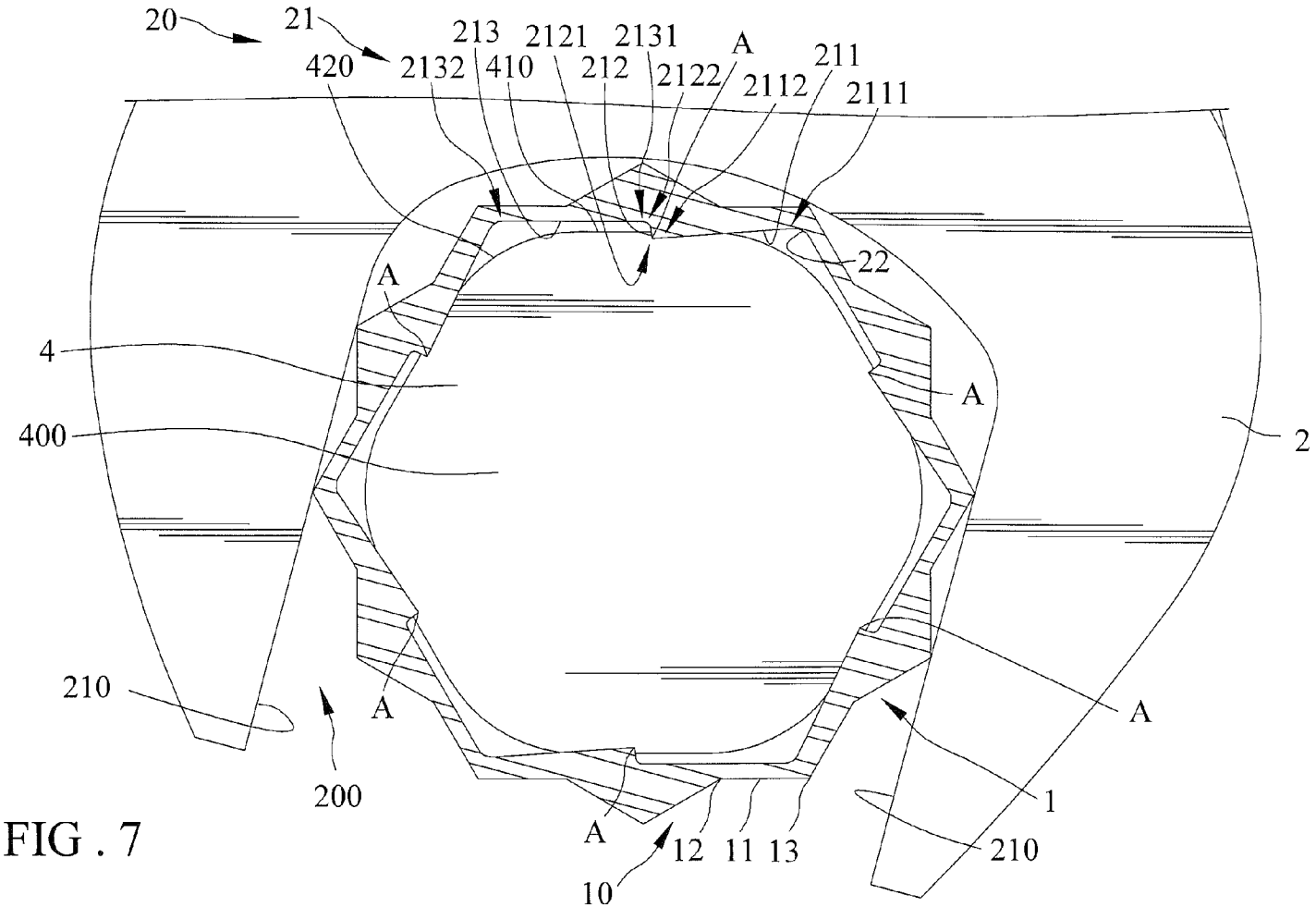
FIG. 7 is a cross-sectional view illustrating a rusted and rotten fastener loosening by the socket shown in FIG. 1.

FIG. 7 shows a fastener 4 includes a head 400 for engagement with the socket 1. The head 400 includes a circumferential edge defining a plurality of peripheral sides 410 and a plurality of corners 420, and each corner 420 is defined between two adjacent peripheral sides 410. The fastener 4 has become rusted and rotten so the peripheral sides 410 thereof are shoveled by the engaging point "A" of each engaging side 21 of the socket 1.

Although not shown, the polygonal outer peripheral edge 10 of the socket 1 may be of hexagonal cross-section or any other configuration adapted to be engaged with a wrench.

Figure 8:
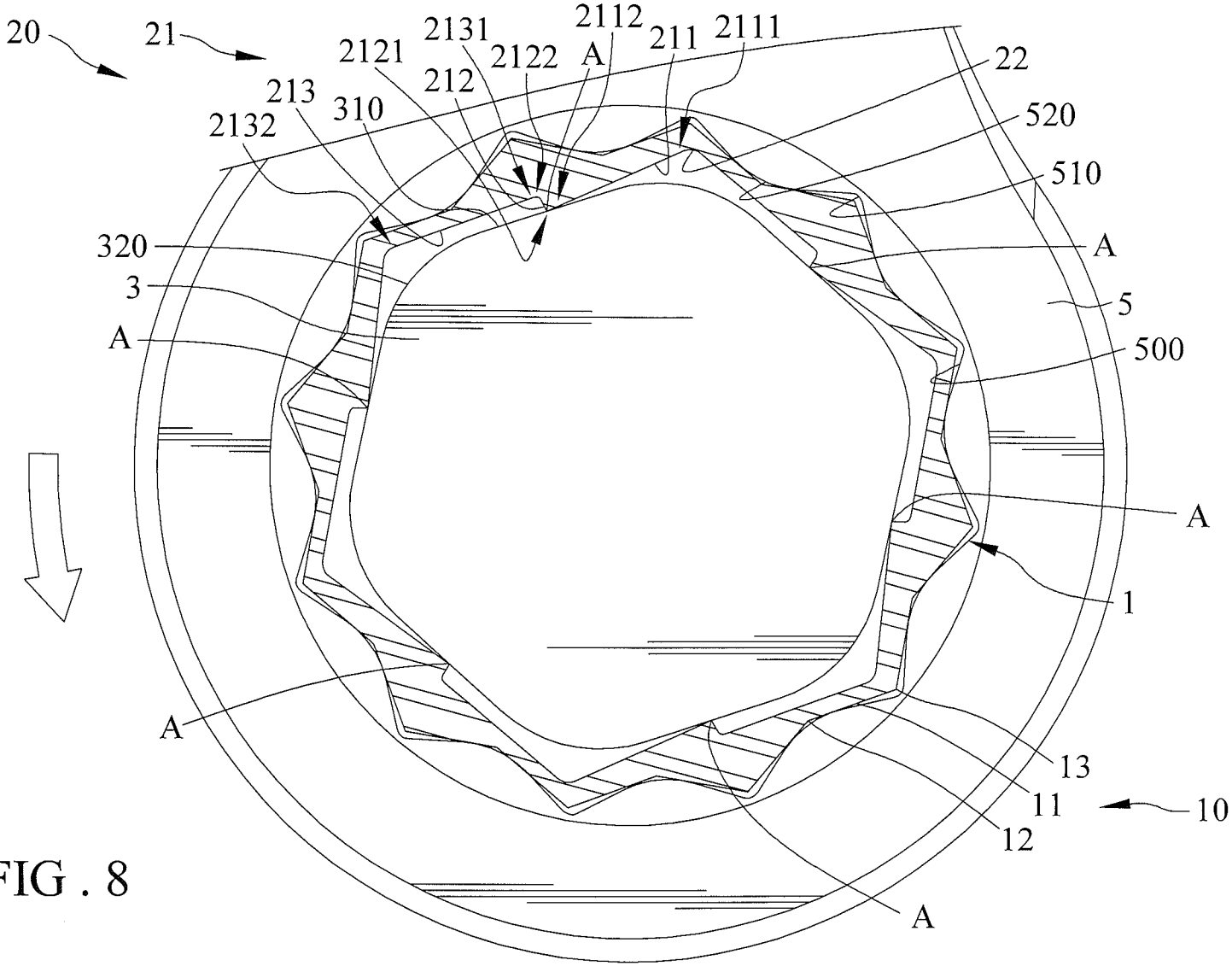
FIG. 8 is a cross-sectional view illustrating the socket shown in FIG. 1 cooperated with a wrenching tool for loosening a fastener.

FIG. 8 shows that a wrenching tool, a wrench 5, engaged with the socket 1 to loosen the fastener 3. The wrench 5 includes a driving end 500 defined at a distal end thereof. The driving end 500 includes an enclosed cavity (not numbered) extending therethrough for accommodating the socket 1. The cavity is polygonal and includes a plurality of sides. In this preferred embodiment, the cavity includes twenty-four sides. Furthermore, each side is defined between two other sides, and defines a first cooperated edge 510 with one of the two other sides 11 and a second cooperated edge 520 with the other of the two other sides 11. In the preferred embodiment, there are twelve first cooperated edges 510 and twelve second cooperated edges 520. Each first cooperated edge 510 is opposing and adjacent to one second cooperated edge 13 defined on the outer peripheral edge 10 of the socket 1. Each second cooperated edge 520 is opposing and adjacent to one first cooperated edge 12 defined on the outer peripheral edge 10 of the socket 1.

In addition, it is possible to use the socket 1 to tighten the fastener 3 and 4 in an object if desired. To do so, the socket 1 engages the fastener 3 and 4 in a manner such that upper and lower sides thereof, extending from the inner peripheral edge 20 to the outer peripheral edge 10 and defined in a case for loosening the fastener 3 and 4, are upside down. Consequently, the socket 1 is turned in a direction not decreasing the acute angle defined between each peripheral side 310 and 410 of the circumferential edge of the head 300 and 400 and the first section 211 of each engaging side 21.

In view of the forgoing, the socket 1 has the greatest thickness defined between the first terminal side 2121 of the second section 212 (or the second terminal side 2112 of the first section 211) defined on the inner peripheral edge 20 thereof and the corresponding second cooperated edge 13 defined on the outer peripheral edge 10 thereof, thereby accomplishing an improved structural strength against a possible deformation problem when undergoing a large toque force during the operation of loosening the fastener 3 and 4. Furthermore, the socket 1 has the advantages that it uses less material than a conventional socket. Another advantage is that the socket 1 has a lower manufacturing cost than a conventional socket, as it is made via a stamping process.

While the specific embodiment has been illustrated and described, numerous modifications come to mind without significantly departing from the spirit of invention, and the scope of invention is only limited by the scope of the accompanying claims.

What is claimed is:

1. A driving member for driving a fastener having a head which a wrenching tool is adapted to engage and which has corners which are or have become damaged, comprising a socket comprising:

a hole extending therethrough and defining an inner peripheral edge having annular cross sections, with the inner peripheral edge defining a plurality of engaging sides and slots extending longitudinally, with two adjacent engaging sides disposed on two opposite boundaries of one slot and each engaging side angled with an adjacent engaging side, with each engaging side including first, second, and third sections extending longitudinally, with the first section including a first terminal side coincident with one of the two boundaries of one slot and a second terminal side and approaching to a center of the hole as the first section extends from the first terminal side to the second terminal side, with the second section including a first terminal side and a second terminal side and extending away from the center of the hole as the second section extends from the first terminal side to the second terminal side, with the first terminal side of the second section connected with the second terminal side of the first section with the second section extending from the first section at a non-parallel angle, with the third section including a first terminal side and a second terminal side coincident with one of the two boundaries of one slot, with the first terminal side of the third section connected with the second terminal side of the second section with the third section extending from the second section at a non-parallel angle to the second section, with each slot radially and equally spaced from the center of the hole;

wherein the socket includes an outer peripheral edge having annular cross sections, with the inner peripheral edge located inwardly and spaced from the outer peripheral edge; and wherein when the socket is engaged with the wrenching tool to drive the fastener, the head of the fastener is received within the hole of the socket and is only in contact with the second terminal side of the first section of each engaging side defining an engaging point prior to operably moving the socket, wherein the outer peripheral edge of the socket is abutted against a driving end of the wrenching tool, and wherein the head of the fastener is aligned coaxially with the socket and the driving end of the wrenching tool and defines a coaxial line, wherein the outer peripheral edge thereof is polygonal and includes a plurality of sides.

2. The driving member as claimed in claim 1, wherein the second section extends from the second terminal side of the first section to the first terminal side of the third section.

3. The driving member as claimed in claim 2, wherein when the socket is engaged with the wrenching tool to drive the fastener, the first section of each engaging side and a peripheral side of the head cooperate to define an acute angle.

4. The driving member as claimed in claim 2, wherein the second terminal side of the first section of each engaging side is radially spaced from the center of the hole by a first radial distance, and wherein each slot is radially spaced from the center by a second radial distance, with the second radial distance greater than the first radial distance.

5. The driving member as claimed in claim 2, wherein each of the plurality of sides of the outer peripheral edge defines a first cooperated edge with one of two adjacent sides and a second cooperated edge with another of the two adjacent sides, with the first and second cooperated edges parallel to each other, with the first and second cooperated edges radially spaced from the center of the hole, with each first cooperated edge closer to the center than each second cooperated edge.

6. The driving member as claimed in claim 5, wherein in each of the plurality of engaging sides, the second section extends towards the second cooperated edge and the first terminal side thereof is spaced from the second cooperated edge that the second section extends towards by a first distance, wherein the first terminal side of the third section is spaced from the second cooperated edge by a second distance, wherein the first terminal side of the first section is spaced from the outer peripheral edge by a first perpendicular distance, and wherein the second terminal side of the third section is spaced from the outer peripheral edge by a second perpendicular distance, with the second distance smaller than the first distance, with the second perpendicular distance smaller than the first perpendicular distance.

7. The driving member as claimed in claim 4, wherein each of the plurality of sides of the outer peripheral edge defines a first cooperated edge with one of two adjacent sides and a second cooperated edge with another of the two adjacent sides, with the first and second cooperated edges parallel to each other, with the first and second cooperated edges radially spaced from the center of the hole, with each first cooperated edge closer to the center than each second cooperated edge.

8. The driving member as claimed in claim 7, wherein in each of the plurality of engaging sides, the second section extends towards the second cooperated edge and the first terminal side thereof is spaced from the second cooperated edge that the second section extends towards by a first distance, wherein the first terminal side of the third section is spaced from the second cooperated edge by a second distance, wherein the first terminal side of the first section is spaced from the outer peripheral edge by a first perpendicular distance, and wherein the second terminal side of the third section is spaced from the outer peripheral edge by a second perpendicular distance, with the second distance smaller than the first distance, with the second perpendicular distance smaller than the first perpendicular distance.

9. The driving member as claimed in claim 2, wherein the coaxial line extends across the head of the fastener, the socket, and a longitudinal line which the wrenching tool extends along.

10. The driving member as claimed in claim 2, wherein the coaxial line extends across the hole, the socket, and the head of the fastener.

11. The driving member as claimed in claim 1, wherein the plurality of engaging sides of the hole is not concentric to the plurality of sides of the outer peripheral edge.

* * * * *